United States Patent [19]

Boerger

[11] Patent Number: 4,723,362

[45] Date of Patent: Feb. 9, 1988

[54] DRIVE DEVICE FOR CLIPPERS

[76] Inventor: Daniel A. Boerger, 5132 Norman St., Racine, Wis. 53406

[21] Appl. No.: 900,162

[22] Filed: Aug. 25, 1986

[51] Int. Cl.[4] ..... B26B 19/02

[52] U.S. Cl. ..... 30/218; 30/219; 74/102

[58] Field of Search ..... 30/217–220, 30/210, 43.9, 43.92; 74/99, 102

[56] References Cited

U.S. PATENT DOCUMENTS 2,549,221 4/1951 Meltzer ..... 74/102 X 2,946,123 7/1960 Bray ..... 30/219

*Primary Examiner*—Douglas D. Watts

*Attorney, Agent, or Firm*—Peter N. Jansson

[57] ABSTRACT

An improved clipper and oscillating drive lever for engaging a slot in the movable cutter of a clipper. The distal end of the lever has two resilient prongs biased to a first spread greater than the dimension of the slot such that the prongs must be squeezed together to engage the slot. Some preferred embodiments include inwardly-turned tips. Reduced noise and improved cutting efficiency are provided.

15 Claims, 5 Drawing Figures

DRIVE DEVICE FOR CLIPPERS

FIELD OF THE INVENTION

This invention is related generally to clippers for cutting hair and the like and, more particularly, to oscillating drive linkages for imparting reciprocating motion to the movable cutters of such clippers.

BACKGROUND OF THE INVENTION

Clippers of the type having a fixed cutter with a first row of teeth and a movable cutter with a second row of teeth which reciprocates with respect to the fixed cutter have long been very well known. The rows of teeth of the fixed and movable cutters are substantially aligned and the movement of the movable cutters produces cutting action between adjacent pairs of teeth. Such cutting movement is usually provided from the rotating drive shaft or an electric motor by means of an oscillating linkage.

Some or such clippers have electric drive motors inside their handles with short drive shafts closely adjacent to the movable cutters. Others have remote drive motors with long drive shafts which are extended to a position adjacent to the movable cutters by means of flexible co-axial cables. Both of these types of drive arrangements include an eccentric device at the end of the drive shaft which is engaged with the movable cutter in some manner by an oscillating linkage.

Various mechanical linkages have been used between the eccentric device and the movable cutter. Many devices include a lever which pivots about a fulcrum, usually a fulcrum somewhere midway along the length of the lever. Such levers each have a distal end engagable in a slot of some sort formed in the movable cutter and a proximal end which is engageable by the eccentric device. This invention is an improvement in clippers and in mechanical linkages of this general type.

Such linkages cause a number of problems primarily related to the wear which occurs between the distal ends of such levers and the movable cutters with which they are engaged, during attachment and subsequent use. Even if the distal end of the lever fits the slot in the movable cutter relatively snugly when the device is new, wear on the distal end and/or on the slot itself quickly results in a fit which is not snug. A gap develops and grows between the distal end and the sides of the slot.

This causes noise. The initial noise may not be very loud, but, as wear causes the size of the gap to grow, a loud and annoying noise develops. The noise is caused by the distal end of the lever repeatedly hitting the opposite walls of the slot in the movable cutter. Extended use without changing cutters and levers increases gap between the distal end and the slot walls and increases the noise. Such noise can be particularly troublesome when the clipper is used in grooming pets and other animals.

The noise can be reduced to some extent by using non-metallic parts, such as a non-metallic lever or a lever having a non-metallic distal end. Plastic and fiberglas levers have been used to reduce the noise problem. However, use of such soft materials can tend to increase the rate of wear.

Another significant problem caused by the aforementioned undesirable gap between the lever distal end and the slot is that the range of effective driving movement of the movable cutter is reduced as the gap develops and increases in size. For an increasing portion of each stroke the movable cutter is not being driven. This decreases the cutting efficiency of the clipper.

The aforementioned gap caused or increased by wear can lead to other problems as well. In some cases, breakages of parts can even occur.

Examples of prior art devices of the type described, including some efforts to address the above-mentioned problems, include the following U.S. Pat. Nos.: 4,531,291 (Laube); 2,271,029 (Oster); and 1,528,745 (Lutes).

Oster addresses some of the aforementioned problems by means of a complex lever device having a pivoting end member. Such devices may be expensive and can be prone to breakage. Lutes utilizes a rounded distal end, an approach also mentioned in the Oster patent. Prior attempts to solve these problems have had a number of disadvantages and shortcomings. In summary, the problems associated with wear between the distal end of the oscillating drive lever and the movable cutter which it engages remain essentially unsolved.

OBJECTS OF THE INVENTION

It is an object of this invention to provide a clipper and an oscillating mechanical linkage for driving the movable cutter of a clipper which overcome certain problems of the prior art, including those mentioned above.

Another object is to provide a clipper which is quiet in operation, even after an extended period of operation.

Another object of this invention is to provide a clipper which operates without lost motion, even after an extended period of operation.

Another object of this invention is to provide an oscillating mechanical drive linkage for clippers which overcomes the aforementioned problems and yet is simple and inexpensive in construction.

These and other important objects will be apparent from the descriptions of this invention which follow.

SUMMARY OF THE INVENTION

This invention is an improved clipper and an improved oscillating mechanical linkage for clippers, overcoming certain problems and disadvantages of prior art devices. The clipper is of the type with a fixed cutter, a movable cutter having a slot, and an oscillating lever which is driven by an eccentric device on a rotating shaft and has a distal end engaged in the slot.

The oscillating lever in the clipper of this invention has a distal end with two spaced resilient prongs which are squeezed toward each other so that, as the distal end engages the slot in the movable cutter, the prongs apply outward pressure on the walls of the slot. The prongs are biased to a first spread which is greater than the dimension of the slot in which the prongs are received.

As the clipper is used, there will, of course, be some wear of the prongs and of the walls of the slot. However, the outward spring pressure of the prongs will cause the prongs to remain in firm gap-free engagement with the slot, even over a very extended period of usage. Thus, no gap will develop and the need to replace cutter or lever because of wear at their point of engagement can be greatly reduced or eliminated.

This relationship of lever distal end and movable cutter slot allows long-term quiet clipper operation. It also allows the application of driving force throughout the full motion of the movable cutter, to provide efficient cutting. Various other problems due to wear, such as breakage of parts and even difficulty with pets, can be significantly reduced.

In certain preferred embodiments, the oscillating lever has two pieces which are connected in face-to-face relationship, one of the two prongs being part of each piece. Such levers are preferably symmetrical, having mirror-image pieces.

It is most preferred that the two pieces extend along the full length of the lever and form an opening therebetween to receive a post which provides a fulcrum about which the lever oscillates. Means interconnecting the two pieces are preferably on either side of the opening to firmly hold the two pieces together. The lever also preferably has a proximal end with a notch formed by the aforementioned two pieces for receiving the eccentric drive device.

The distal end of the oscillating lever is preferably made of spring steel. Indeed, the aforementioned two pieces are preferably made entirely of spring steel. Spring steel is highly preferred because it is hard, has a good elastic memory, and provides a strong outward spring force when the two prongs are squeezed together.

The two prongs preferably have inwardly-turned tips the natural spread of which allows insertion of the distal end into the slot without first squeezing the prongs together. Thus, when the clipper is being assembled or when the clipper head is being engaged with the distal end of the lever, insertion of the prongs into the slot can easily begin, and continued insertion causes the prongs to engage the walls of the slot and squeeze the prongs together until the distal end is fully inserted into the slot. At that point, the prongs are under tension.

DETAILED DESCRIPTIONS OF PREFERRED EMBODIMENTS

Figure 1:
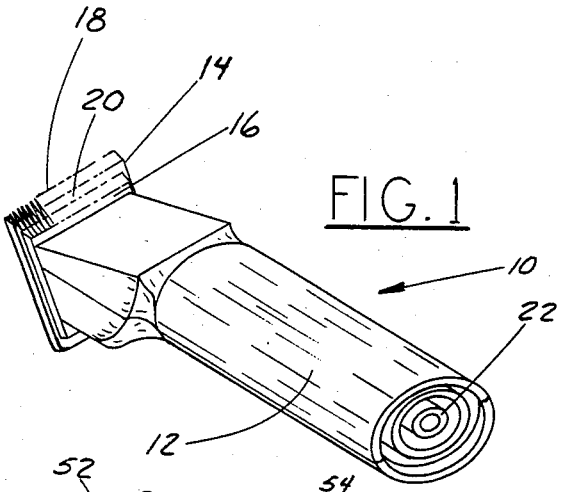
FIG. 1 is a perspective view of a preferred clipper in accordance with this invention.
Figure 4:
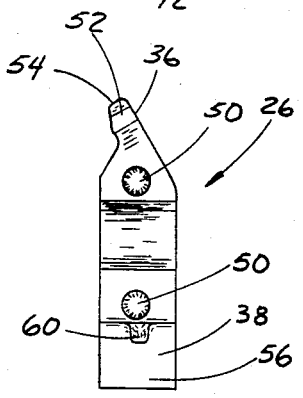
FIG. 4 is a side elevation of FIG. 3.

The figures illustrate preferred clipper 10 used for cutting hair and the like.

Clipper 10 includes a handle 12 which also forms the body to which various parts of clipper 10 are attached. Clipper 10 has a fixed cutter 14, which is attached to handle 12 by means not shown, and a movable cutter 16, which is movably mounted with respect to fixed cutter 14. Fixed and movable cutters 14 and 16 have rows of teeth 18 and 20, respectively, which are generally aligned one with another in overlapping fashion. When cutter 16 moves, its row of teeth 20 reciprocates back and forth along the row of teeth 18 of fixed cutter 14, all in known fashion.

Clipper 10 is of the type having a remote drive motor, not shown in the drawings. A co-axial drive cable (not shown) engages drive shaft 22, which rotates with the drive cable on a axis which is fixed with respect to handle 12. A drive knob or eccentric device 24 is eccentrically mounted at the end of drive shaft 22. As drive shaft 22 rotates on its fixed axis, eccentric drive knob 24, having convex sides 25, moves from side to side in a generally circular path. Such side-to-side motion is transferred to movable cutter 16 by means of an oscillating lever 26, which is a key element of this invention.

Movable cutter 16 has a slot 28 on its upper surface 30. Slot 28 extends from a first lateral wall 32 to a second lateral wall 34. First and second lateral walls 32 and 34 face one another. The spacing between lateral walls 32 and 34 is referred to herein as the dimension of slot 28. Slot 28 is deep enough to receive the distal end 36 of oscillating lever 26.

The end of oscillating lever 26 which is opposite distal end 36 is proximal end 38. Proximal end 38 includes a notch 40 dimensioned to tightly receive eccentric drive knob 24.

Midway along the length of oscillating lever 26 is a opening 42 which allows oscillating lever 26 to be mounted over a pivot post 44 which is rigidly attached to handle structure 12 of clipper 10. Pivot post 44 provides a fulcrum about which lever 26 oscillates. A bushing 46 is tightly engaged to the remainder of oscillating lever 26 and provides a bearing on which lever 26 oscillates around pivot post 44.

Oscillating lever 26 is symmetrical, having two mirror-image pieces 48 which are preferably of spring steel. Spring steel pieces 48 are tightly riveted together by rivets 50, such connection points being on either side of opening 42. The riveting of spring steel pieces 48 together firmly sandwiches bushing 46 in place. Spot welding may be used instead of rivets.

Figure 3:
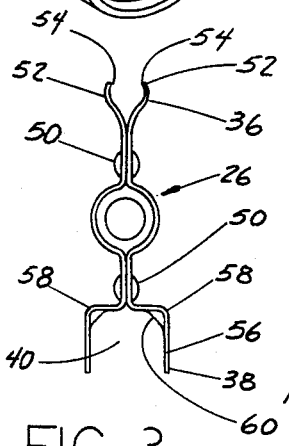
FIG. 3 is a top plan view of the lever of this invention removed from its engagement in the clipper.
Figure 5:
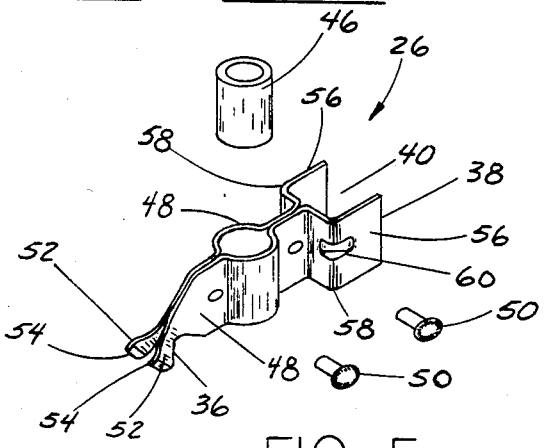
FIG. 5 is an exploded perspective view of FIG. 3.
Figure 2:
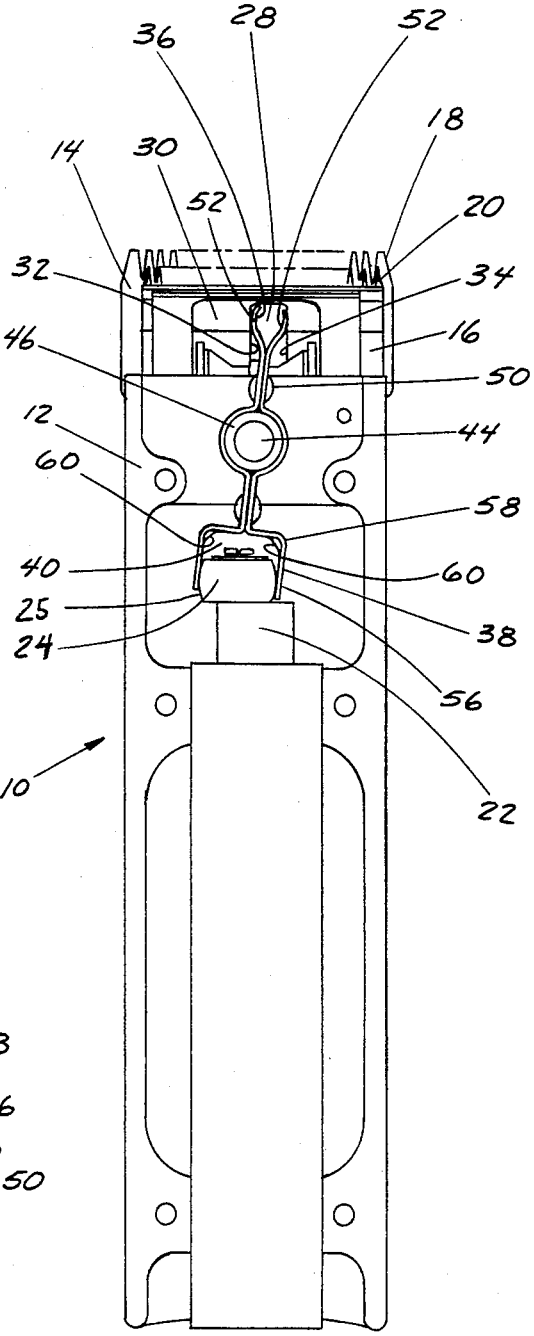
FIG. 2 is an enlarged top plan view with a portion of the casing removed to better illustrate the internal mechanisms pertinent to this invention.

Distal end 36 of oscillating lever 26 includes a pair of mirror-image resilient prongs 52, which are at one of the ends of each of spring steel pieces 48. Prongs 52 are biased to a first spread, illustrated in FIG. 3, which is greater than the aforementioned dimension of slot 28. Thus, when distal end 36 is engaged in slot 28, prongs 52 are squeezed toward each other and exert an outward force on first and second lateral walls 32 and 34 of slot 28. This sort of engagement is gap-free even after there has been significant wear of prongs 52 and/or of first and second lateral walls 32 and 34.

Prongs 52 have inwardly-turned tips 54 which, when prongs 52 are biased to their natural spread, are spaced apart by a distance slightly less than the aforementioned dimension of slot 28. This is helpful in inserting distal end 36 into slot 28, as is necessary whenever the cutter assembly is pushed into place for operation. After initial insertion of inwardly-turned tips 54 into slot 28, continued insertion along the curved prongs 52 causes compression of prongs 52 toward each other until they reach the point of full insertion.

Notch 40 is formed by a pair of spaced notch sides 56 which preferably exert a squeezing force on eccentric drive knob 24. The bend lines 58 along each notch side 56 include a detent 60 which is pressed therein. Detents 60 strengthen bend lines 58 and insure that notch sides 56 remain in tight engagement with eccentric drive knob 24.

The wear between eccentric drive knob 24 and notch sides 56 is minimal compared to the wear that can occur at distal end 36. However, in both cases the outward tension exerted by the ends of spring steel pieces 48 insures continued firm substantially gap-free engagement of parts. This in turn eliminates noise problems, lost motion problems, and the other problems caused or aggravated by wear.

Oscillating lever 26 may be made of spring steel of thickness sufficient to provide the necessary spring pressure, structural strength, and durability. Lever 26 may be formed of materials other than spring steel. Hard wear-resistant resilient materials are required for best operation of this invention.

Oscillating lever 26 may be made in non-symmetrical forms and may be made with other than two pieces. The prongs may be resilient while the remainder of the lever is made of other materials which are less resilient.

The other parts of the clipper of this invention may be made using well-known and readily available parts and materials. Bushing 46 is preferably made of brass, but a variety of other materials may be used. Fixed and movable cutters 14 and 16 are preferably made of high carbon steel, and handle 12 may be made of metal or plastic.

While the principles of this invention have been described in connection with specific embodiments, it should be understood clearly that these descriptions are made only by way of example and are not intended to limit the scope of the invention.

What is claimed is:

1. In a clipper of the type with a fixed cutter, a movable cutter having a slot, and an oscillating lever which is driven by an eccentric device on a rotating shaft and has a distal end engaged in the slot, the improvement wherein:

the slot has opposed lateral walls spaced apart by a first distance; and the distal end has two spaced prongs each engaging one of the opposed lateral walls, said prongs being resilient and outwardly biased, solely by virtue of such resilience, toward a first spread substantially greater than the first distance such that their engagement with the lateral walls is with force, whereby said prongs will automatically spread to accommodate wear.

2. The clipper of claim 1 wherein the lever comprises two pieces connected in face-to-face relationship, each of said pieces forming one of the prongs.

3. In a clipper of the type with a fixed cutter, a movable cutter having a slot, and an oscillating lever which is driven by an eccentric device on a rotating shaft and has a distal end engaged in the slot, the improvement wherein the distal end has two spaced resilient prongs squeezed toward each other to engage the slot, the lever comprising two pieces in mirror-image form connected in face-to-face relationship, each of the pieces forming one of said prongs.

4. In a clipper of the type with a pivot post, a fixed cutter, a movable cutter having a slot, and an oscillating lever pivotably mounted on the post, said oscillating lever being driven by a rotating eccentric device and having a distal end engaged in the slot, the improvement wherein the distal end has two spaced resilient prongs squeezed toward each other to engage the slot, the lever comprising two peices connected in face-to-face relationship, each piece forming one of the prongs and the pieces together forming a post-receiving opening therebetween.

5. In an oscillating lever of the type for use in a clipper having a fixed cutter, a movable cutter with a slot in which a distal end of the lever is engaged, and an eccentric driving device engaging a proximal end of the lever, the improvement comprising:

the distal end of the lever including two resilient prongs biased to a first spread greater than the dimension of the slot such that the prongs must be squeezed together to engage the slot; and the lever including two pieces connected in face-to-face relationship and forming a fulcrum-receiving opening therebetween, each of said pieces forming one of the two prongs.

6. The clipper of claim 4 having means interconnecting the two pieces on either side of the opening.

7. The clipper of claim 6 wherein the connecting means are rivets.

8. The clipper of claim 6 wherein the lever has a proximal end with a notch formed by the two pieces for receiving the eccentric device.

9. The clipper of claim 1 wherein the prongs are of spring steel.

10. The clipper of claim 1 wherein the prongs have inwardly-turned tips whereby insertion into the slot may begin without first squeezing the prongs together.

11. The lever of claim 5 having means interconnecting the two pieces on either side of the opening.

12. The lever of claim 11 wherein the connecting means are rivets.

13. The lever of claim 11 wherein the proximal end has a notch formed by the two pieces for receiving the eccentric device.

14. The lever of claim 11 wherein the two pieces are spring steel.

15. The lever of claim 5 wherein the prongs have inwardly-turned tips whereby insertion into the slot may begin without first squeezing the prongs together.

* * * * *